US007487902B2

(12) United States Patent
Philips et al.

(10) Patent No.: US 7,487,902 B2
(45) Date of Patent: Feb. 10, 2009

(54) TRIANGULAR SHAPED CONTAINER AND ASSOCIATED CONTAINER BLANK

(75) Inventors: Nicholas A Philips, Sugar Grove, IL (US); James Gregg Harbison, McComb, MS (US)

(73) Assignee: International Paper Co., Memphis, TN (US)

( * ) Notice: Subject to any disclaimer, the term of this patent is extended or adjusted under 35 U.S.C. 154(b) by 0 days.

(21) Appl. No.: 11/694,456

(22) Filed: Mar. 30, 2007

(65) Prior Publication Data

US 2008/0237328 A1 Oct. 2, 2008

(51) Int. Cl.
*B65D 5/20* (2006.01)
*B65D 5/66* (2006.01)

(52) U.S. Cl. ..... 229/115; 229/145; 229/151; 229/186

(58) Field of Classification Search ..... 229/115, 229/186, 145, 149, 151, 154, 906; 206/551
See application file for complete search history.

(56) References Cited

U.S. PATENT DOCUMENTS 879,488 A * 2/1908 Pitkin ..... 229/112
1,282,209 A * 10/1918 Frank ..... 222/215
2,265,326 A * 12/1941 Stopper ..... 229/151
2,701,090 A * 2/1955 Buttery ..... 229/115
3,623,650 A * 11/1971 Watts ..... 229/186
4,114,797 A * 9/1978 Manizza ..... 229/169
5,037,026 A * 8/1991 Hanko ..... 229/125.29
5,098,013 A * 3/1992 France et al. ..... 229/115
5,118,033 A * 6/1992 Kula ..... 229/115
5,213,255 A * 5/1993 Cote ..... 229/115
2003/0006273 A1* 1/2003 Tsern et al. ..... 229/906

* cited by examiner

*Primary Examiner*—Gary E Elkins

(57) ABSTRACT

The present invention includes a blank and container formed of cellulose-based materials configured to form a triangular shaped container. The container includes a triangular shaped bottom panel, side walls and a rear wall that define a first triangular volume. The top panel and second side panels generally form a second triangular volume that is slightly larger than the first triangular volume. The second triangular volume is configured to fold over the first triangular volume such that the top panel and second side panels fully enclose the bottom panel and the first side panels. The container is locked by a friction fit between juxtaposed tabs inserted into a slot located between the ends of the intersecting first side panels.

11 Claims, 4 Drawing Sheets

TRIANGULAR SHAPED CONTAINER AND ASSOCIATED CONTAINER BLANK

FIELD OF THE INVENTION

This invention relates generally to blanks and the resulting containers and more specifically to blanks resulting in containers that are triangular in shape.

BRIEF DESCRIPTION OF THE DRAWINGS

Various embodiments of the present invention are best understood from the following detailed description when read in connection with the accompanying drawings. It is emphasized that, according to common practice, various features of the drawings are not to scale. On the contrary, the dimensions of the various features are arbitrarily expanded or reduced for clarity. Included are the drawings for the following figures.

DETAILED DESCRIPTION OF THE PREFERRED EMBODIMENTS

Various aspects of the present invention will now be described with reference to the accompanying drawings. The present invention is directed to a blank 20 and container 40 that are designed to hold triangular shaped objects, such as, without limitation, individual pizza or pie/cake slices or objects wherein a triangular shaped container is desired. One suitable embodiment of the blank 20 and container 40, constructed in accordance with aspects of the present invention, is illustrated in FIGS. 1 through 7. An additional embodiment is depicted in FIG. 8. Specific details of the blank 20 and the resulting container 40 are described in more particularity below.

Figure 1:
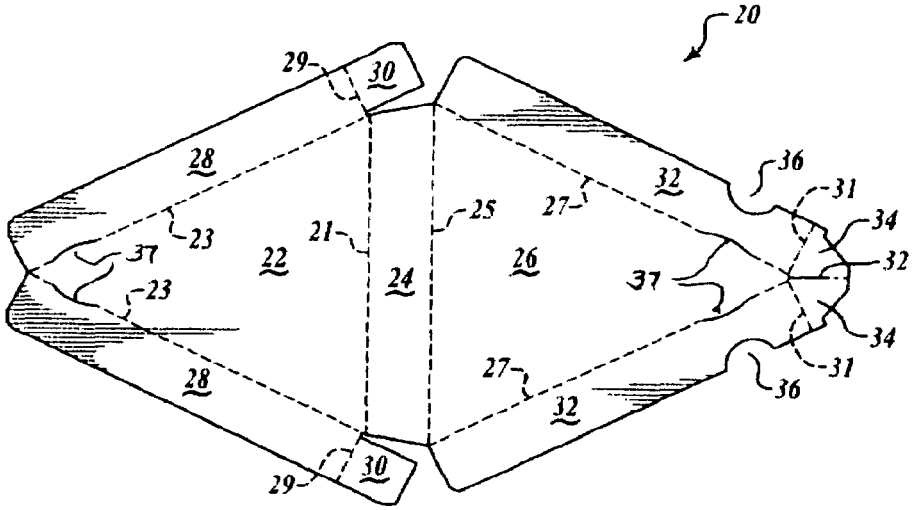
FIG. 1 is a plan view of a single piece of container blank formed in accordance with the present invention.
Figure 2:
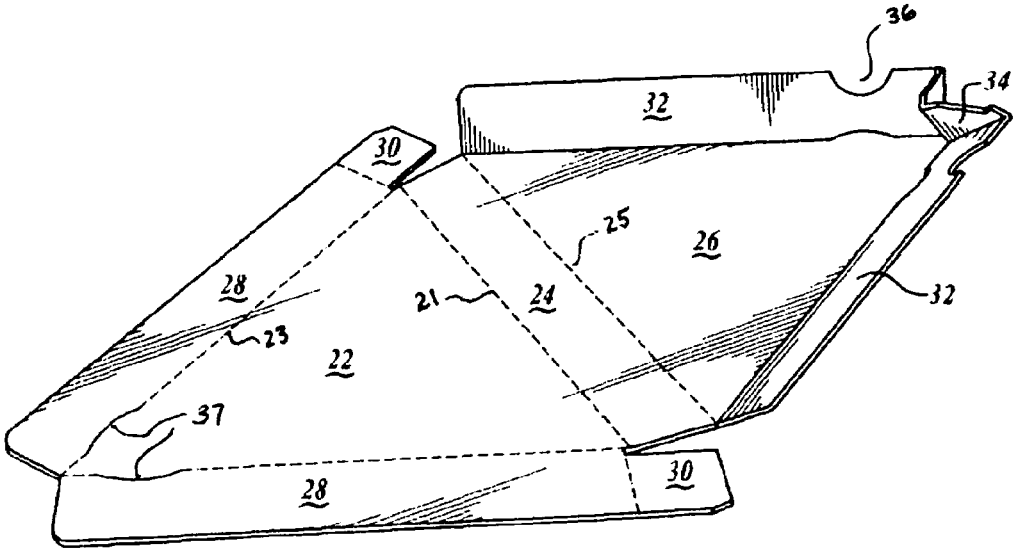
FIG. 2 is a perspective view of a partially assembled container blank depicted in FIG. 1.
Figure 3:
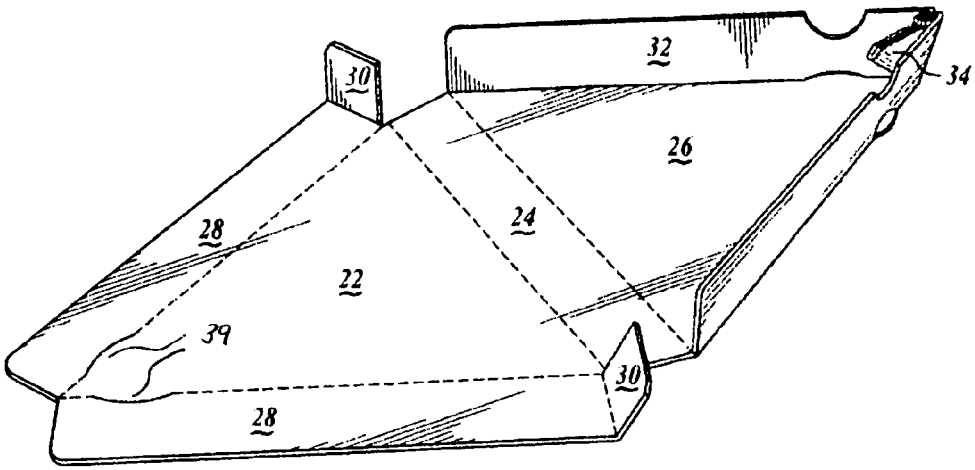
FIG. 3 is another perspective view of a more fully assembled container formed from the container blank of FIG. 1.
Figure 4:
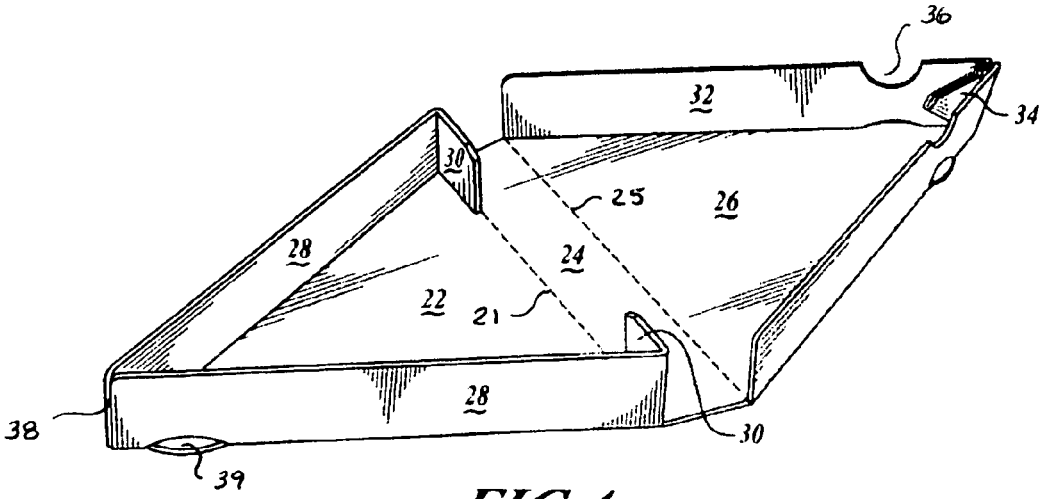
FIG. 4 is yet another perspective view of a further assembled container formed from the container blank of FIG. 1.
Figure 5:
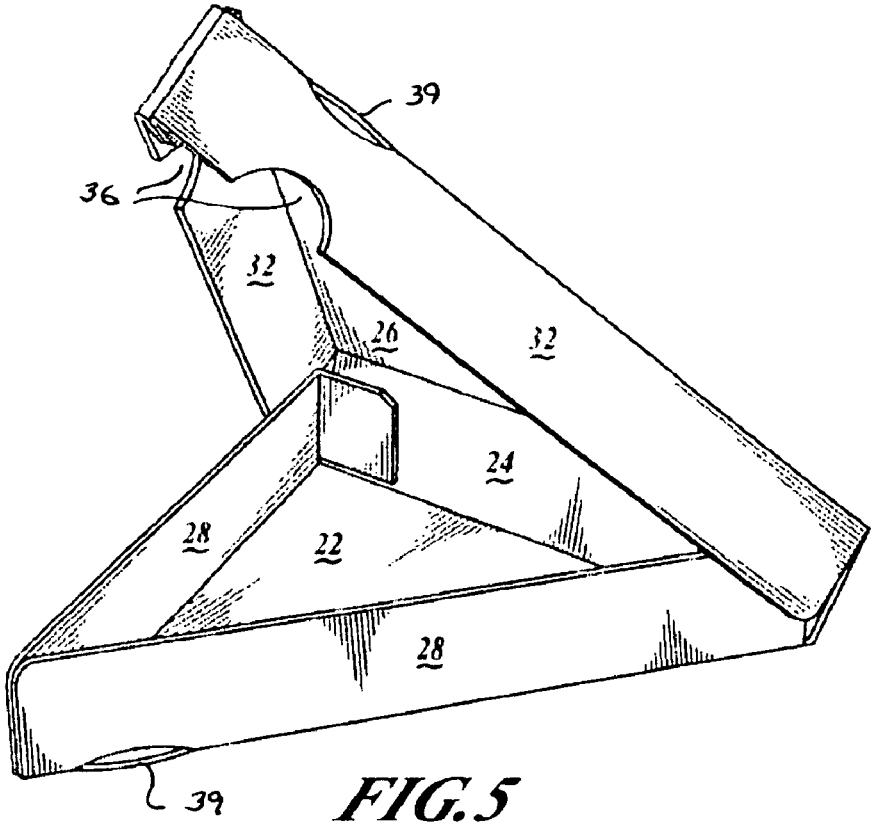
FIG. 5 is yet another perspective view of a further assembled container formed from the container blank of FIG. 1.
Figure 6:
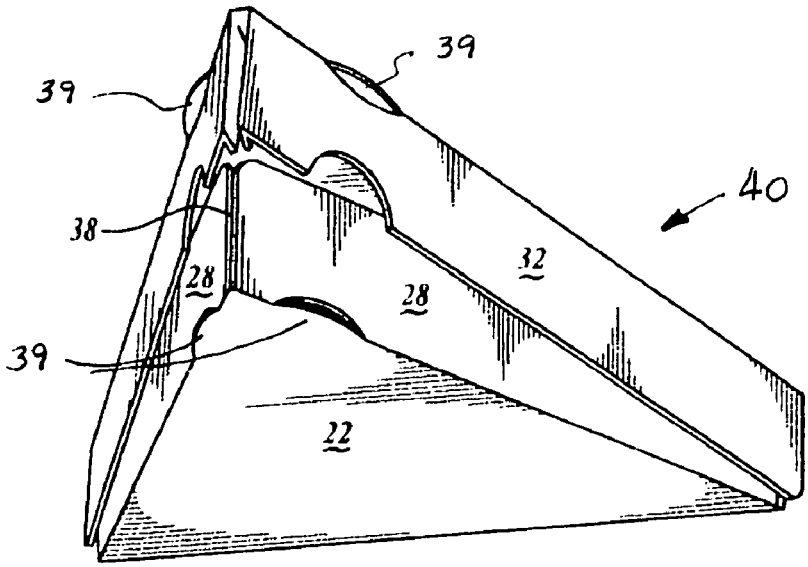
FIG. 6 is a perspective view of a further assembled container resulting from the erection of the blank of FIG. 1.

FIG. 1 depicts a blank 20 used to form the container 40. The blank 20 is typically constructed from a single piece of formable material such as, without limitation, sheets of cellulose-based material formed from cellulose material such as pulp, straw, cotton, bagasse or the like. Cellulose-based materials used in the present invention come in many forms, such as fiberboard, containerboard, corrugated containerboard and paperboard. The blank 20 is cut, scored, perforated or otherwise formed into a plurality of panels that, when assembled, form container 40. In all FIGURES, like numbers indicate like parts. Additionally, cut lines are shown as solid lines, score lines as dashed and lines of perforation as broken lines.

For the purposes of further description herein, the downward direction is defined as the direction perpendicular to the bottom panel 22 that corresponds to the outer surface of panel 22 when the container 40 has been erected. The upward direction is defined as the direction perpendicular to the bottom panel 22 which corresponds to any inner surface of the bottom panel 22 when the container 40 has been erected.

Referring to FIG. 1, the blank 20 includes a bottom panel 22. The bottom panel 22 is generally triangular and defined at its outer perimeter by fold lines 23 and 21. Hingedly connected to the bottom panel 22 along fold lines 23 are first side panels 28. In one particular embodiment, corner tabs 30 are connected to the first side panels 28 along a fold line 29. Rear panel 24 is hingedly connected to the bottom panel 22 along a fold line 21.

A top panel 26 is connected to the rear panel 24 along a fold line 25. Fold line 25 and fold line 21 are substantially parallel to one another and are separate from one another by the width of the rear panel 24 measured in a line perpendicular to fold lines 21 and 25. Panel 26 is substantially similar to bottom panel 22 in overall geometry. The top panel 26 is bounded by fold lines 25 along the rear panel, and intersecting fold lines 27. Second side panels 32 are hingedly connected to the top panel 26 along the fold lines 27.

Each second side panel 32 is hingedly attached to a tab 34 along fold line 31. Each of the tabs 34 are hingedly connected to one another along a bellows fold line 33.

FIGS. 2 through 6 depict various stages of the container 40 being erected from the blank 20. Specifically, tabs 34 are pushed inwardly with respect to one another along bellows fold line 33. The tabs 34 are pushed together such that the tabs 34 are juxtaposed one another. By pushing on the tabs 34 as disclosed, the second side panels 32 are folded upwardly along fold lines 27. At this stage, the top half of the container 40 is substantially formed.

Corner tabs 30 are folded approximately 90 degrees along fold lines 29. Further, first side panels 28 are folded approximately 90 degrees along fold lines 23. First side panels 28 and corner tabs 30 define the general lower half of the container 40.

Top panel 26 may then be folded such that top panel 26 and rear panel 24 are folded upwardly along fold line 21. Top panel 26 and second side panels 32 may then be folded along fold lines 25 to complete the closing of the container 40.

The respective upper and lower portions of the container 40 are held in a "locked" arrangement by the insertion of the juxtaposed tabs 34 into a slot 38 formed at the intersection of the respective first side panels 28.

Figure 7:
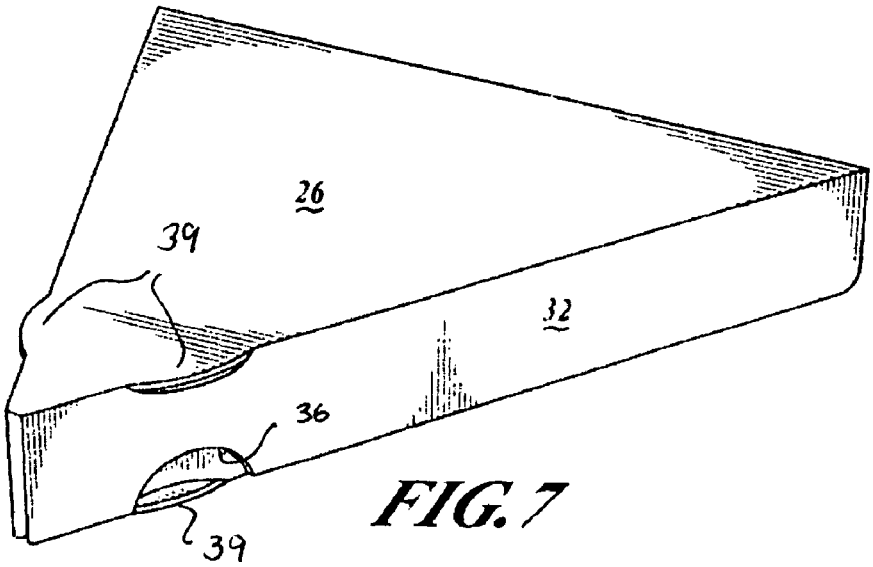
FIG. 7 is a top perspective view of a container erected from the blank of FIG. 1.
Figure 8:
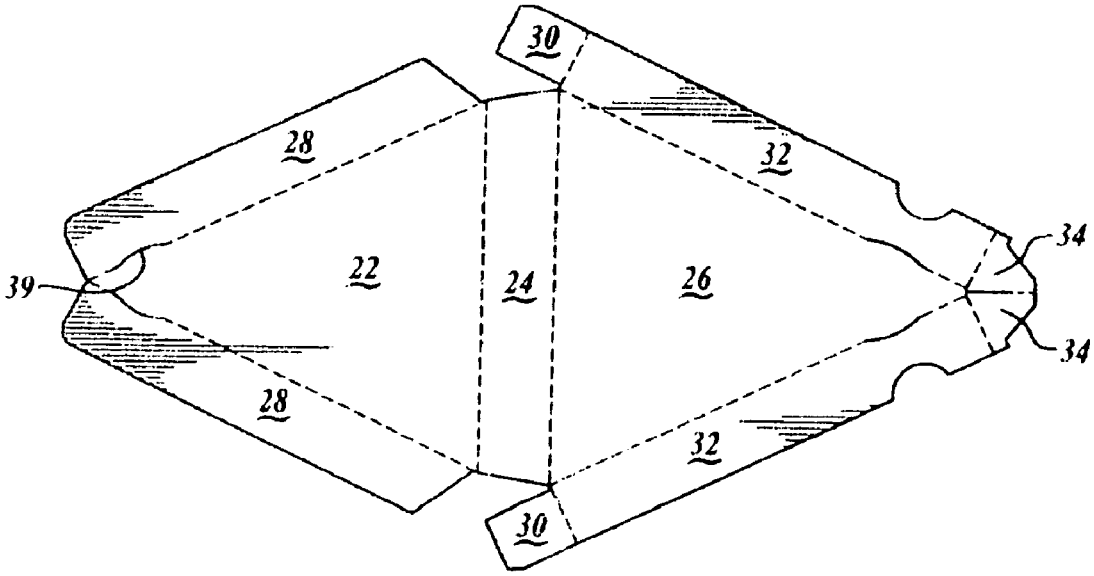
FIG. 8 is a plan view of an alternative embodiment of container blank for erecting a container according to the invention.

FIG. 7 depicts the final container 40 in its closed form.

With specific reference to FIG. 8, an alternative embodiment is disclosed. In this particular embodiment, the corner tabs 30 are hingedly connected to an end of the second side panels 32 rather than the first side panels 28, as depicted above. The erection of the container is substantially the same as discussed above, and as such will not be discussed in detail herein.

In all embodiments, any variety of vents or slots may be included or excluded without departing from the spirit and scope of this invention. Likewise, a variety of other additional features such as grease barriers may also be included. For example, a quick opening slot or notch 36 is disclosed near the tabs 34, and arched cuts 37 near the intersection of the respective first and second side panels form finger tabs 39 in a container erected from the blank.

It will also be appreciated that throughout this application, the terms "top" and "bottom" have been used to refer to the various triangular panels. These terms are not intended to limit the scope of this invention, as the container 40 may be used with either triangular panel being used a top or a bottom.

The various embodiments disclose a triangular container that may be used with any product wherein a triangular shaped container is desired. Suitable, non limiting examples of such situations include individual pizza and pie slices.

While various embodiments of this invention have been illustrated and described as noted above, many changes can be made without departing from the spirit and scope of the invention. Accordingly, the scope of the invention is not limited by the disclosure of the various embodiments. Instead, the invention should be determined entirely by the reference to the claims that follow.

What is claimed is:

1. A triangularly shaped container that may be stored and shipped in a flattened condition and erected at a point of use, said container folded from a single cut and scored blank of foldable material, and comprising:

a triangularly shaped bottom panel having an apex end and a base end;

a pair of substantially rectangular first side panels connected with the bottom panel along respective first fold lines extending along opposite side edges of the bottom panel, said first side panels extending from the base end to the apex end of the bottom panel and spaced from one another at the apex end to define a narrow slot;

a substantially rectangular rear panel foldably connected along a second fold line to the base end of the bottom panel;

a triangularly shaped top panel having an apex end and a base end, said top panel being foldably connected at its base end along an edge of the rear panel opposite the bottom panel, said top panel extending in spaced overlying relationship parallel to the bottom panel;

a pair of substantially rectangular second side panels connected with the top panel along respective third fold lines extending along opposite side edges of the top panel, said second side panels extending from the base end to the apex end of the top panel; and a pair of tabs foldably connected to respective said second side panels at the apex end of the top panel and foldably connected to each other along a fold to define a web connecting said second side panels at the apex end of the top panel, said tabs being juxtaposed with one another and received in the slot between the first side panels at the apex end of the bottom panel, with the second side panels lying outside respective adjacent said first side panels and adjacent ends of the first side panels engaged between adjacent ends of the second side panels and respective adjacent said tabs to hold the container in its erected condition.

2. The container of claim 1, wherein the single sheet of foldable material is formed from a cellulose-based material.

3. The container of claim 2, wherein the cellulose-based material is formed from at least one of a wood pulp, straw, cotton, and bagasse.

4. The container of claim 2, wherein the cellulose-based material is in the form of at least one of a fiberboard, containerboard, corrugated containerboard and paperboard.

5. A container as claimed in claim 1, wherein:

a corner tab is foldably connected to the end of each said first side panel at the base end of the bottom panel, said corner tabs being folded inwardly to lie along an inner surface of said rear panel.

6. A container as claimed in claim 1, wherein:

a corner tab is foldably connected to the end of each said second side panel at the base end of the top panel, said corner tabs being folded inwardly to lie along an inner surface of said rear panel.

7. A container as claimed in claim 1, wherein:

a finger access notch is formed in a bottom edge of at least one of said second side panels to facilitate opening of said container.

8. A container as claimed in claim 7, wherein:

outwardly protruding finger tabs are formed on said top and bottom panels to facilitate opening of said container.

9. A single blank of foldable material cut and scored for making a triangularly shaped container having spaced parallel top and bottom triangular panels, said blank comprising:

a triangularly shaped bottom panel having an apex end and a base end;

a pair of substantially rectangular first side panels connected with the bottom panel along respective first fold lines extending along opposite side edges of the bottom panel, said first side panels extending from the base end to the apex end of the bottom panel and in a container erected from the blank spaced from one another at the apex end to define a narrow slot;

a substantially rectangular rear panel foldably connected along a second fold line to the base end of the bottom panel;

a triangularly shaped top panel having an apex end and a base end, said top panel being foldably connected at its base end along an edge of the rear panel opposite the bottom panel so that in a container erected from the blank said top panel extends parallel to the bottom panel in spaced overlying relationship thereto;

a pair of substantially rectangular second side panels connected with the top panel along respective third fold lines extending along opposite side edges of the top panel, said second side panels extending from the base end to the apex end of the top panel; and a pair of tabs foldably connected to respective said second side panels at the apex end of the top panel and foldably connected to each other along a fold to define a web connecting said second side panels at the apex end of the top panel, said tabs adapted to be juxtaposed with one another in a container erected from said blank and to be received in the slot between the first side panels at the apex end of the bottom panel, said second side panels adapted to lie outside respective adjacent said first side panels in a container erected from said blank, and adjacent ends of the first side panels adapted to be engaged between adjacent ends of the second side panels and respective adjacent said tabs in a container erected from said blank to hold the container in its erected condition.

10. A blank as claimed in claim 9, wherein:

a corner tab is foldably connected to the end of each said first side panel at the base end of the bottom pane, said corner tabs adapted to be folded inwardly to lie along an inner surface of said rear panel in a container erected from said blank.

11. A blank as claimed in claim 9, wherein:

a corner tab is foldably connected to the end of each said second side panel at the base end of the top panel, said corner tabs adapted to be folded inwardly to lie along an inner surface of said rear panel in a container erected from said blank.

* * * * *